United States Patent [19]

Reiland

[11] 4,030,188

[45] June 21, 1977

[54] METHOD OF MAKING SHAKER PLATES

[75] Inventor: Dennis J. Reiland, St. Paul, Minn.

[73] Assignee: General Pattern Co., Inc., St. Paul, Minn.

[22] Filed: June 11, 1976

[21] Appl. No.: 694,961

[52] U.S. Cl. ..... 29/527.1; 164/45; 264/227; 264/342 R

[51] Int. Cl.² ..... B22C 9/18

[58] Field of Search ..... 29/527.1; 164/45, 13; 264/227, 342 R

[56] References Cited

UNITED STATES PATENTS

| | | | |
|---|---|---|---|
| 2,396,195 | 3/1946 | Pattison | 164/45 |
| 3,065,511 | 11/1962 | Leitzel | 164/45 |
| 3,552,480 | 1/1971 | Harris | 164/45 |

*Primary Examiner*—Robert D. Baldwin

[57] ABSTRACT

A process by which a complex shape of a sand core is reproduced in a metal plate which is made to the exact size of the sand core through a double casting process using different materials.

7 Claims, No Drawings

METHOD OF MAKING SHAKER PLATES

BACKGROUND OF THE INVENTION

1. Field of the Invention

This invention relates generally to shaker plates and, more specifically, to a method making a shaker plate which exactly and precisely fits the outline of a sand core which has ridge of flash sand that must be removed.

2. Description of the Prior Art

In today's foundries, a typical high speed molding machine can cycle every 15 to 20 seconds. Many of the molds used in these machines require identical sand cores. Typically, the sand cores are made with curing sands which are placed in metal core boxes that are heated to about 500° F. above room temperature. This firing produces a rigid but somewhat fragile sand core which can be used with the molding machines. After removing the sand cores from the metal core boxes, the sand cores are usually not ready to be placed into a mold as the sand cores require mechanical cleaning by removing the flashsand located at the joint where the two halves of the metal core boxes join. The sand web or flash is the result of the fine grains of sand collecting at the joint of the core box and then hardening as a thin ridge or web during the curing stage of the sand core.

In the past, the cleaning or deburring has been done by hand by core room personnel who use either a file or a wire to scrape off the sand ridge. If this excess flash sand is not completely removed from the entire core, the casting made in the mold which uses this sand core could be ruined because of the mis-shaping of the final cast article.

Another prior art process is to make a metal shaker plate that passes over the sand core and removes the flash by the vibration of the plate.

The present invention is to a process of manufacturing a shaker plate which precisely and exactly passes over the sand core so that it can be used to strip off any unwanted ridges of sand on the sand core. In actual operation, the sand core is passed through a vibrating flat steel plate called a "stripper plate." This stripper plate has a two-dimensional opening which is substantially identical to the sand core. The vibration of the plate cuts or shears off the unwanted web of fine sand grains on the sand core. The use of a shaker plate reduces the time involved in removing the web of sand along the flash joint and allows for automated finishing of sand cores in a matter of a few seconds rather than minutes.

The problem involved with this process is how to make a shaker plate which has the same dimensions as the sand core. The reason it is difficult to do so is the metal core box pattern and the sand core have a different dimensioneven though the sand core is made in the metal core box. The reason the sand core is larger than the metal core box is that to make the sand core, the metal core box temperature is increased by about 500° F. This produces a thermal expansion of the metal core box which results in the sand core curing and hardening in the expanded metal core box. As a result, the sand core is substantially larger than the metal core box when both are at room temperature. Consequently, it is difficult to use the room temperature undersized metal core box as a pattern for making a shaker plate. The present invention overcomes this difficulty through a process of casting which compensates for the undersized metal core box.

BRIEF SUMMARY OF THE INVENTION

Briefly, the invention comprises a method of manufacturing a shaker plate for use in the removal of sand grains on a sand core which has been fired in an expanding metal core box by first using the metal core box to make a plaster core which expands at a predetermined rate followed by using the plaster core to form a pattern for an epoxy resin mold which shrinks at a predetermined rate. The actual metal shaker plate is made by use of a duplicate milling machine which follows the outline of the epoxy mold.

DESCRIPTION OF THE PREFERRED EMBODIMENT

Typically, a metal core box is used to make a sand core by first placing the curing sand in the metal core box. Next, the sand and the metal core box are heated to approximately 500° F. or greater. This causes an expansion in the metal core box (usually cast iron) of approximately 0.0027 inches per inch over the room temperature dimensions.

The process of manufacturing a shaker plate which will have dimensions which are identical to the sand core is accomplished by first pouring plaster into the metal core box in which the sand mold was made. The plaster is selected on the basis that it has the characteristic of expanding upon curing. Other materials which expand upon curing could also be used; however, plaster is preferred bacause of its cast and expansion characteristcs which match up fairly close to the metal molds expansion. A preferred plaster is the type which has an expansion of 0.003 inches per inch. Suitable types of plaster can be obtained from various sources.

Briefly, gypsum cement is a calcium sulfate $CaSo_4$ that occurs in nature as Anhydrite and in the hydrated form as gypsum. The gypsum cements used have a compressive wet strength of 2,200 psi. and has a dry strength of 5,300 psi. and an expansion of 0.003 inches per inch. However, from the invention standpoint, the only critical aspect is the characteristic of expansion upon curing. The use of various fillers can be employed to control the expansion of the gypsum, however, both of the above gypsum cements contain the proper characteristics of expansion rate for use in the present invention. That is, both of these gypsum cements are characterised by an expansion of 0.003 inches per inch during setting.

After the plaster core has been cast in the metal core box, the plaster core is removed and allowed to cure. After curing, the plaster core is actually larger than the sand core, i.e., the thermal expansion of the metal core box was only 0.0027 inches per inch while the expansion characteristics of the plaster was 0.003 inches per inch. To distinguish the expansion characteristics, the expansion of metal core box will be designated by C and the expansion of the plaster by P.

The next step is to convert the plaster core into a core by using the plaster mold to form a mold which contracts rather than expands upon curing. Typically, a plastic or epoxy resin has this characteristic of contraction upon curing. The type of epoxy resins are the epoxy resins characterized by the chemical structure contained in epoxide groups (Oxirane rings). The epoxy resins are well known in the art and will not be described herein. However, a typical suitable epoxy resin is characterized by a shrinkage factor of 0.0003 inches per inch. The amount of contraction of the epoxy resin will be denoted by R.

It should be noted that the particular materials used is not significant, but it is significant that the material have the desired characteristics of expansion or contraction.

After the epoxy mold has been cast, the plaster core can be thrown away. After the epoxy mold has been cast from the plaster core, the dimensions of the epoxy mold will be exactly those of the sand core. That is, since the plaster expands 0.003 inches per inch and the epoxy shrinks 0.0003 inches per inch, one produces an oversizing of the final mold of 0.0027 inches per inch. This expansion exactly corresponds to the final dimensions of the sand core.

Accordingly, we have $C - (P+R) = 0$ or the thermal expansion factor has been offset by the use of the process of making two extra molds.

In the next step, the epoxy resin model will be used as a pattern in a duplicate milling machine to mechanically mill the shaker plate. The epoxy mold is then discarded as it has no further use.

I claim:

1. The method of making a metal shaker plate for removing flash sand from a sand core comprising the steps of:

placing a curing sand into a metal core box which is at a first temperature, heating the metal core box and the curing sand to a predetermined temperature to cure the sand and thereby produce a sand core, said metal core box undergoing a thermal expansion as a result of heating said metal core box to a predetermined temperature so that said sand core has extended dimensions which are equal to the internal dimensions of the metal core box when said metal core box is at the predetermined temperature;

forming a second core in said metal core box while said metal core box is maintained at the first temperature by use of a material that is characterized by an expansion of a predetermined amount upon setting which is greater than the thermal expansion of said metal core box;

using the second core as a pattern for casting a mold from a material which is characterized by a predetermined amount of shrinkage during the curing stage, said expansion of said second core and said contraction of said mold producing a dimensional compensation which is equal to the thermal expansion of said metal core box so that the mold has the same direction as the sand mold formed in said metal core box; and using said mold as a pattern in making a shaker plate for said sand core.

2. The process of claim 1 wherein said shaker plate is made milling on a duplicate milling machine that uses said mold as a pattern.

3. The process of claim 2 wherein the first temperature is about 70° F.

4. The process of claim 3 wherein the predetermined temperature is about 500° F.

5. The process of claim 4 wherein the material for said second core is characterized by an expansion of about 0.003 inches per inch during the curing.

6. The process of claim 5 wherein the material for said mold is characterized by a shrinkage of about 0.0003 inches per inch during curing.

7. The process of claim 6 wherein the thermal expansion of said metal core box is about 0.0027 inches per inch.

* * * * *

UNITED STATES PATENT OFFICE

CERTIFICATE OF CORRECTION

Patent No. 4,030,188 Dated June 21, 1977

Inventor(s) Dennis J. Reiland

It is certified that error appears in the above-identified patent and that said Letters Patent are hereby corrected as shown below:

Claim 1, Col. 4, line 16, change "direction" to -- dimension --.

Claim 1, Col. 3, line 35, change "extended" to -- external --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*